US012584290B2

(12) United States Patent
Kimura et al.

(10) Patent No.: US 12,584,290 B2
(45) Date of Patent: Mar. 24, 2026

(54) SYSTEM FOR CONTROLLING WORK MACHINE, METHOD, AND WORK MACHINE

(71) Applicant: KOMATSU LTD., Tokyo (JP)

(72) Inventors: Shoya Kimura, Tokyo (JP); Takehiro Shibata, Tokyo (JP); Takatoshi Matsui, Tokyo (JP); Tomoki Hirayama, Tokyo (JP); Yosuke Yamagoe, Tokyo (JP); Ryohei Kikuzawa, Tokyo (JP)

(73) Assignee: KOMATSU LTD., Tokyo (JP)

( * ) Notice: Subject to any disclaimer, the term of this patent is extended or adjusted under 35 U.S.C. 154(b) by 95 days.

(21) Appl. No.: 18/703,759

(22) PCT Filed: Nov. 11, 2022

(86) PCT No.: PCT/JP2022/042062
§ 371 (c)(1),
(2) Date: Apr. 23, 2024

(87) PCT Pub. No.: WO2023/100620
PCT Pub. Date: Jun. 8, 2023

(65) Prior Publication Data

US 2025/0230630 A1 Jul. 17, 2025

(30) Foreign Application Priority Data

Nov. 30, 2021 (JP) ..... 2021-194901

(51) Int. Cl.
*E02F 9/20* (2006.01)
*E02F 9/18* (2006.01)
*E02F 9/26* (2006.01)

(52) U.S. Cl.
CPC ..... *E02F 9/2025* (2013.01); *E02F 9/18* (2013.01); *E02F 9/2004* (2013.01); *E02F 9/26* (2013.01)

(58) Field of Classification Search
CPC . E02F 3/435; E02F 9/18; E02F 9/2004; E02F 9/2025; E02F 9/26; E02F 9/264
See application file for complete search history.

(56) References Cited

U.S. PATENT DOCUMENTS 11,014,620 B2 * 5/2021 Dini ..... B62D 49/0628
2020/0131737 A1 4/2020 Suzuki et al.
(Continued)

FOREIGN PATENT DOCUMENTS

JP 6-74661 U 10/1994
JP 7-207711 A 8/1995
(Continued)

OTHER PUBLICATIONS

The International Search Report for the corresponding international application No. PCT/JP2022/042062, issued on Dec. 13, 2022.

*Primary Examiner* — Tyler J Lee
(74) *Attorney, Agent, or Firm* — Spencer Fane LLP

(57) ABSTRACT

A work machine includes a plurality of constituent portions including a first portion. A system for the work machine includes a storage device, an input device, and a controller. The storage device stores center of gravity positions of the plurality of constituent portions. The input device receives input of a first parameter for determining the center of gravity position of the first portion. The controller calculates a center of gravity position of the entire work machine based on the center of gravity positions of the plurality of constituent portions. The controller sets the center of gravity position of the first portion by using the first parameter when the first parameter is inputted with the input device. The controller sets the center of gravity position of the entire
(Continued)

work machine based on the center of gravity positions of the plurality of constituent portions that include the set center of gravity position of the first portion.

19 Claims, 14 Drawing Sheets

(56) References Cited

U.S. PATENT DOCUMENTS

| | | | | |
|---|---|---|---|---|
| 2020/0247487 | A1* | 8/2020 | Dini | B62D 49/085 |
| 2022/0106764 | A1 | 4/2022 | Iwasaki et al. | |

FOREIGN PATENT DOCUMENTS

| | | | |
|---|---|---|---|
| JP | 2019-52499 | A | 4/2019 |
| JP | 2020-125594 | A | 8/2020 |
| JP | 2021-59842 | A | 4/2021 |
| JP | 2021-152275 | A | 9/2021 |

* cited by examiner

| TYPE | MASS | L3 | ... |
|---|---|---|---|
| BUCKET A | **** kg | **** m | **** m |
| BUCKET B | **** kg | **** m | **** m |
| BREAKER | **** kg | **** m | **** m |

56

FIG. 11

SYSTEM FOR CONTROLLING WORK MACHINE, METHOD, AND WORK MACHINE

CROSS-REFERENCE TO RELATED APPLICATIONS

This application is a U.S. National stage application of International Application No. PCT/JP2022/042062, filed on Nov. 11, 2022. This U.S. National stage application claims priority under 35 U.S.C. § 119 (a) to Japanese Patent Application No. 2021-194901, filed in Japan on Nov. 30, 2021, the entire contents of which are hereby incorporated herein by reference.

BACKGROUND

Technical Field

The present invention relates to a system for controlling a work machine, a method, and a work machine

Background Information

A technique for calculating the center of gravity position of an entire work machine and for assessing the possibility of overturning of the work machine is known in the prior art. For example, Japanese Patent Laid-open No. 2019-52499 indicates that a concentrated mass point model is used as a calculation model for deriving the center of gravity position of a hydraulic excavator. In the concentrated mass point model, it is assumed that the mass is concentrated at the center of gravity of each constituent portion of the hydraulic excavator. The hydraulic excavator is equipped with a boom, an arm, a bucket, a rotating body, and a traveling body. The center of gravity position of the hydraulic excavator is determined by combining the center of gravity position of the boom, the center of gravity position of the arm, the center of gravity position of the bucket, the center of gravity position of the rotating body, and the center of gravity position of the traveling body.

SUMMARY

There is a work machine in which a portion of the constituent portions are exchanged with other components after shipment. For example, the bucket of a hydraulic excavator may be replaced with another type of attachment. Alternatively, the counterweight of the rotating body may be replaced with one of a different specification. In such cases, the center of gravity position of the replaced constituent portion is changed from the center of gravity position of the constituent portion before the replacement. As a result, it is difficult to accurately calculate the center of gravity position of the entire work machine. An object of the present invention is to accurately calculate the center of gravity position of the entire work machine even after a portion of the constituent portions have been replaced in the work machine.

A system according to a first aspect of the present invention is for a work machine having a plurality of constituent portions including a first portion. The system comprises a storage device, an input device, and a controller. The storage device stores the center of gravity positions of each of the plurality of constituent portions. The input device receives input of a first parameter for determining the center of gravity position of the first portion. The controller calculates the center of gravity of the entire work machine based on the center of gravities of the plurality of constituent portions. The controller sets the center of gravity of the first portion by using the first parameter when the first parameter is inputted with the input device. The controller sets the center of gravity of the entire work machine based on the center of gravities of the plurality of constituent portions including the set center of gravity of the first portion.

A method according to a second aspect of the present invention is a method for controlling a work machine having a plurality of constituent portions including a first portion. The method comprises: acquiring the center of gravity positions of each of a plurality of constituent portions; calculating the center of gravity position of the entire work machine based on the center of gravity positions of the plurality of constituent portions; receiving the input of a first parameter for determining the center of gravity position of the first portion via an input device; setting the center of gravity position of the first portion by using the first parameter when the first parameter is inputted with the input device; and setting the center of gravity position of the entire work machine based on the center of gravity positions of the plurality of constituent portions including the set center of gravity position of the first portion.

A work machine according to a third aspect of the present invention comprises a plurality of constituent portions, a storage device, an input device, and a controller. The plurality of constituent portions include a first portion. The storage device stores the center of gravity positions of each of the plurality of constituent portions. The input device receives input of a first parameter for determining the center of gravity position of the first portion. The controller calculates the center of gravity of the entire work machine based on the center of gravities of the plurality of constituent portions. The controller sets the center of gravity of the first portion by using the first parameter when the first parameter is inputted with the input device. The controller sets the center of gravity of the entire work machine based on the center of gravities of the plurality of constituent portions including the set center of gravity of the first portion.

According to the present invention, when a first portion of a work machine is replaced, a first parameter of the replaced first portion is inputted with an input device whereby the center of gravity position of the first portion is set. The center of gravity position of the entire work machine is calculated based on the set center of gravity position of the first portion. Consequently, the center of gravity position of the entire work machine is calculated accurately even after the first portion has been replaced.

BRIEF DESCRIPTION OF THE DRAWINGS

FIG. 11 illustrates an example of specification data.

DETAILED DESCRIPTION OF EMBODIMENT(S)

Figure 1:
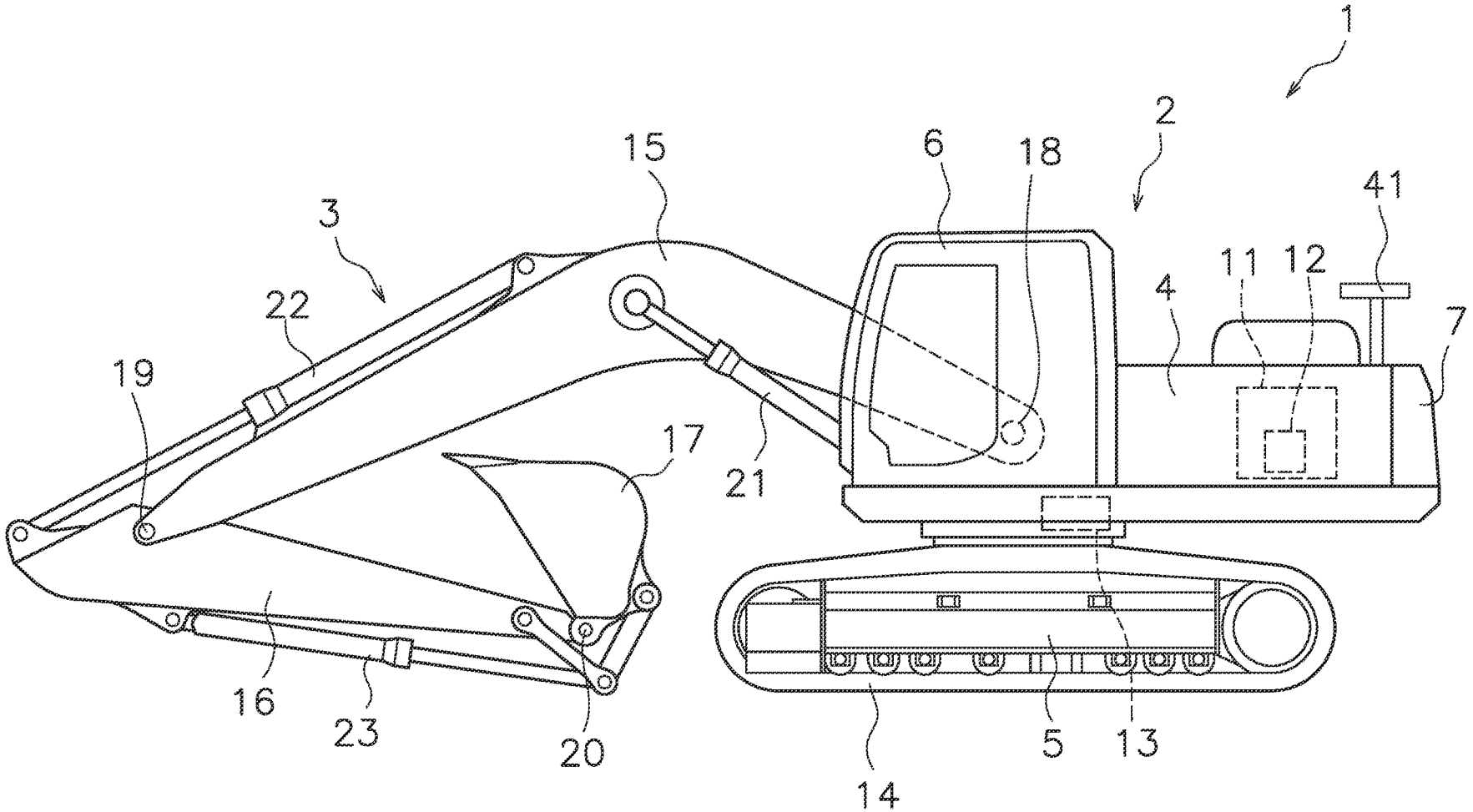
FIG. 1 is a side view of a work machine according to an embodiment.

The following is a description of a work machine according to a first embodiment of the present invention with reference to the drawings. FIG. 1 is a side view of a work machine 1 according to the embodiment. As illustrated in FIG. 1, the work machine 1 includes a vehicle body 2 and a work implement 3. The vehicle body 2 includes a rotating body 4 and a traveling body 5. The rotating body 4 is rotatably supported by the traveling body 5. An operating cabin 6 is disposed on the rotating body 4. A counterweight 7 is attached to the rotating body 4.

The rotating body 4 includes a driving source 11 and a hydraulic pump 12. The driving source 11 is, for example, an internal combustion engine. However, the driving source 11 may also be an electric motor or a hybrid mechanism of an engine and an electric motor. The hydraulic pump 12 is driven by the driving source 11 and discharges hydraulic fluid. The work machine 1 includes a rotation motor 13. The hydraulic fluid discharged from the hydraulic pump 12 is supplied to the rotation motor 13. As a result, the rotation motor 13 causes the rotating body 4 to rotate. The traveling body 5 includes crawler belts 14. The work machine 1 travels due to the rotation of the crawler belts 14.

The work implement 3 is attached to the vehicle body 2. The work implement 3 is movable with respect to the vehicle body 2. The work implement 3 includes a boom 15, an arm 16, and an attachment 17. The boom 15 is rotatably attached to the vehicle body 2 via a boom pin 18. The arm 16 is rotatably attached to the boom 15 via an arm pin 19. The attachment 17 is rotatably attached to the arm 16 via an attachment pin 20.

The work implement 3 includes a boom cylinder 21, an arm cylinder 22, and an attachment cylinder 23. The boom cylinder 21, the arm cylinder 22, and the attachment cylinder 23 are hydraulic cylinders. The boom cylinder 21, the arm cylinder 22, and the attachment cylinder 23 are driven by hydraulic fluid from the hydraulic pump 12. The boom cylinder 21 extends and contracts whereby the boom 15 moves. The arm cylinder 22 extends and contracts whereby the arm 16 moves. The attachment cylinder 23 extends and contracts whereby the attachment 17 moves.

Figure 2:
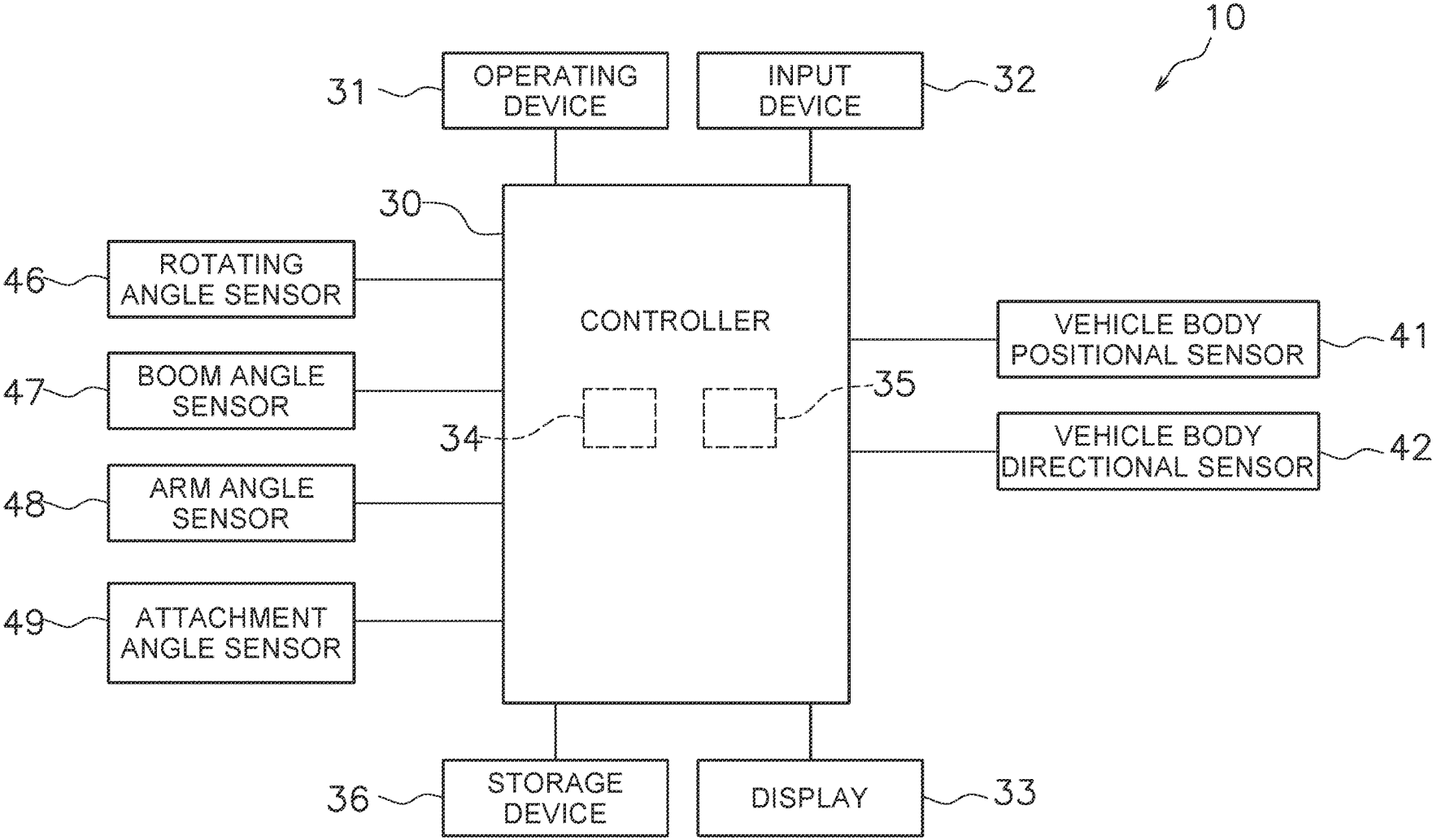
FIG. 2 is a block diagram illustrating a configuration of a control system of the work machine.

FIG. 2 is a block diagram illustrating a control system 10 of the work machine 1. As illustrated in FIG. 2, the control system 10 includes an operating device 31, an input device 32, and a display 33. The operating device 31, the input device 32, and the display 33 are disposed in the operating cabin 6. The operating device 31 is a device for operating the work implement 3, the rotating body 4, and the traveling body 5. The operating device 31 receives operations from an operator for driving the work implement 3, the rotating body 4, and the traveling body 5, and outputs operation signals corresponding to the operations. The operating device 31 includes, for example, a lever, a pedal, and a switch and the like.

The input device 32 receives operations by the operator for setting the control of the work machine 1, and outputs operation signals corresponding to the operations. The input device 33 is, for example, a touchscreen. Alternatively, the input device 32 may include a lever or a switch. The display 33 displays images corresponding to instruction signals inputted to the display 33. The display 33 displays a screen for performing the settings for controlling the work machine 1.

The control system 10 includes a controller 30 and a storage device 36. The controller 30 is programmed so as to control the work machine 1 based on acquired data. The controller 30 includes a processor 34 such as a central processing unit (CPU), and a memory 35 such as a random access memory (RAM) and a read-only memory (ROM). The storage device 36 includes a semiconductor memory or a hard disk and the like. The storage device 36 is an example of a non-transitory recording medium that can be read by the processor 30. The storage device 36 stores programs and data for controlling the work machine 1. The controller 30 acquires operation signals from the operating device 31 and the input device 32. The controller 30 controls the work implement 3, the rotating body 4, and the traveling body 5 based on the operation signals.

The control system 10 includes a vehicle body positional sensor 41. The vehicle body positional sensor 41 detects the position of the vehicle body 2. The vehicle body positional sensor 41 is disposed on the rotating body 4. The vehicle body positional sensor 41 is a positional sensor that uses, for example, a global navigation satellite system (GNSS). The vehicle body positional sensor 41 detects the position of the rotating body 4 in a standard coordinate system. The standard coordinate system is a coordinate system that has a point of origin OW (see FIG. 5) outside of the work machine 1 and complies with, for example, a world geodetic system. The controller 30 acquires positional data that indicates the position of the rotating body 4 from the vehicle body positional sensor 41.

The control system 10 includes a vehicle body directional sensor 42. The vehicle body directional sensor 42 is attached to the rotating body 4. The vehicle body directional sensor 42 detects the orientation of the rotating body 4.

The vehicle body directional sensor 42 is, for example, an inertial measurement unit (IMU). The vehicle body directional sensor 42 detects the yaw angle, the roll angle, and the pitch angle of the rotating body 4 as the orientation of a constituent portion. The controller 30 acquires directional data that indicates the orientation of the rotating body 4 from the vehicle body directional sensor 42.

The control system 10 includes a rotating angle sensor 46, a boom angle sensor 47, an arm angle sensor 48, and an attachment angle sensor 49. The rotating angle sensor 46 detects the rotating angle of the rotating body 4 with respect to the traveling body 5. The controller 30 calculates the orientation of the traveling body 5 from the orientation of the rotating body 4 and the rotating angle of the rotating body 4.

Figure 3:
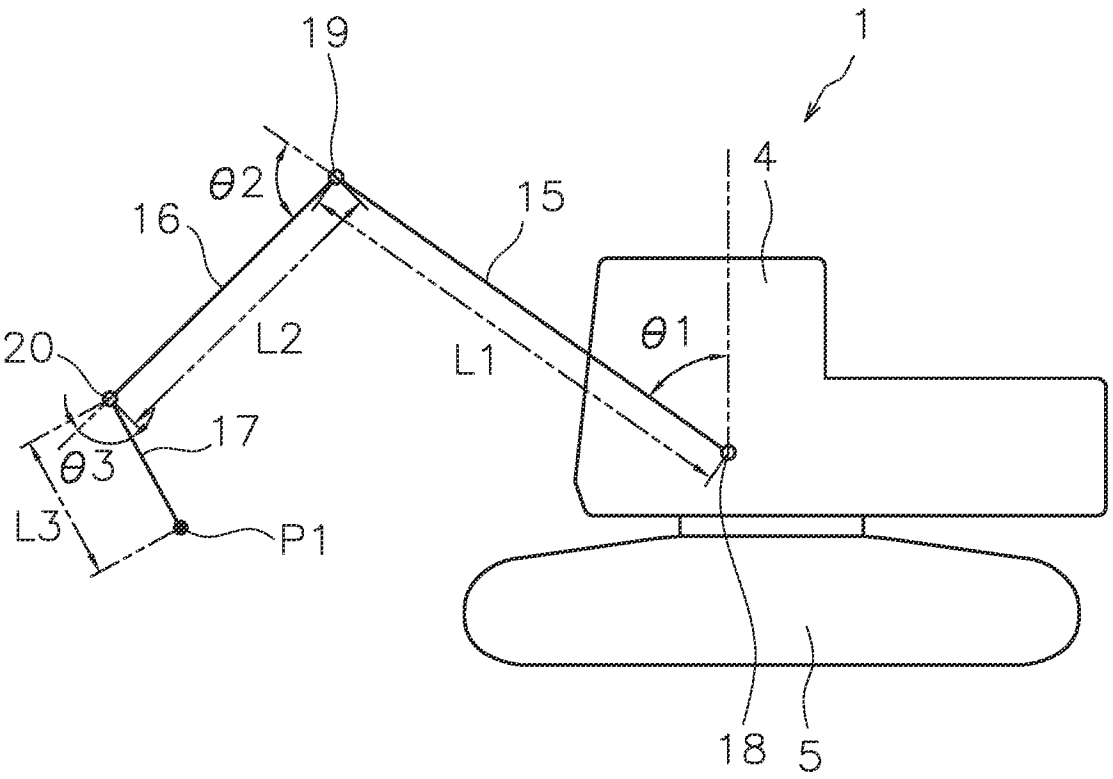
FIG. 3 is a schematic view of a configuration of the work machine.

FIG. 3 is a schematic view of a configuration of the work machine 1. The boom angle sensor 47 detects a boom angle θ1. The boom angle θ1 indicates the inclination angle of the boom 15 with respect to the rotating body 4. The arm angle sensor 48 detects an arm angle θ2. The arm angle θ2 indicates the inclination angle of the arm 16 with respect to the boom 15. The attachment angle sensor 49 detects an attachment angle θ3. The attachment angle θ3 indicates the inclination angle of the attachment 17 with respect to the arm 16.

The attachment angle sensor 49 is, for example, a stroke sensor. The attachment angle sensor 49 detects the stroke amount of the attachment cylinder 23. The controller 30 calculates the attachment angle θ3 from the stroke amount. The arm angle sensor 48 and the boom angle sensor 47 are, for example, IMUs. Alternatively, the arm angle sensor 48 and the boom angle sensor 47 may also be stroke sensors. The attachment angle sensor 49 may also be an IMU.

Alternatively, the boom angle sensor 47, the arm angle sensor 48, and the attachment angle sensor 49 may also be angle sensors that directly detect the respective boom angle θ1, the arm angle θ2, and the attachment angle θ3. The controller 30 acquires angle data that indicates the rotation angle, the boom angle θ1, the arm angle θ2, and the attachment angle θ3 from the rotating angle sensor 46, the boom angle sensor 47, the arm angle sensor 48, and the attachment angle sensor 49.

Figure 4:
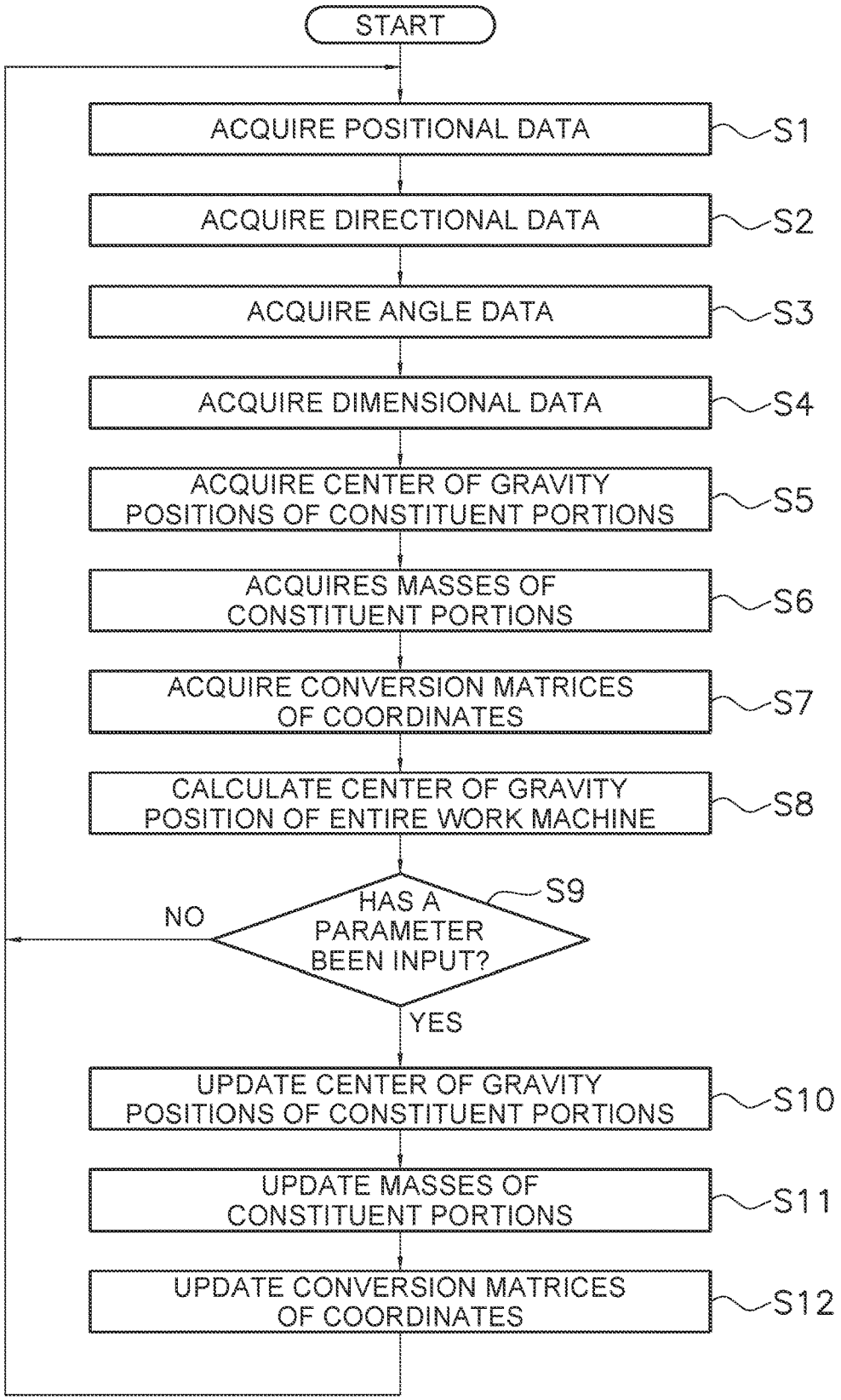
FIG. 4 is a flow chart illustrating processing for calculating the center of gravity position of the entire work machine.

Next, processing executed by the controller 30 for calculating the center of gravity position of the entire work machine 1 will be explained. In the present embodiment, the work machine 1 is divided into a plurality of constituent portions, and the center of gravity position of the entire work machine 1 is calculated from the center of gravity positions and the masses of each of the constituent portions. FIG. 4 is a flow chart illustrating processing for calculating the center of gravity position of the entire work machine.

As illustrated in step S1 in FIG. 4, the controller 30 acquires positional data. The controller 30 acquires the position of the rotating body 4 in the standard coordinate system by using the positional data. In step S2, the controller 30 acquires directional data. The controller 30 acquires the orientation of the rotating body 4 from the directional data. In step S3, the controller 30 acquires angle data. The controller 30 acquires the rotation angle, the boom angle θ1, the arm angle θ2, and the attachment angle θ3 from the angle data.

In step S4, the controller 30 acquires dimensional data. The dimensional data indicates the dimensions of the constituent portions for calculating the center of gravity position of the entire work machine 1. As illustrated in FIG. 3, the dimensional data includes, for example, a boom length L1, an arm length L2, and an attachment length L3. The boom length L1 is the distance between the boom pin 18 and the arm pin 19. The arm length L2 is the distance between the arm pin 19 and the attachment pin 20. The attachment length L3 is the length between the attachment pin 20 and the tip end P1 of the attachment 17. The dimensional data is stored in the storage device 36. The controller 30 acquires the dimensional data from the storage device 36.

Figure 5:
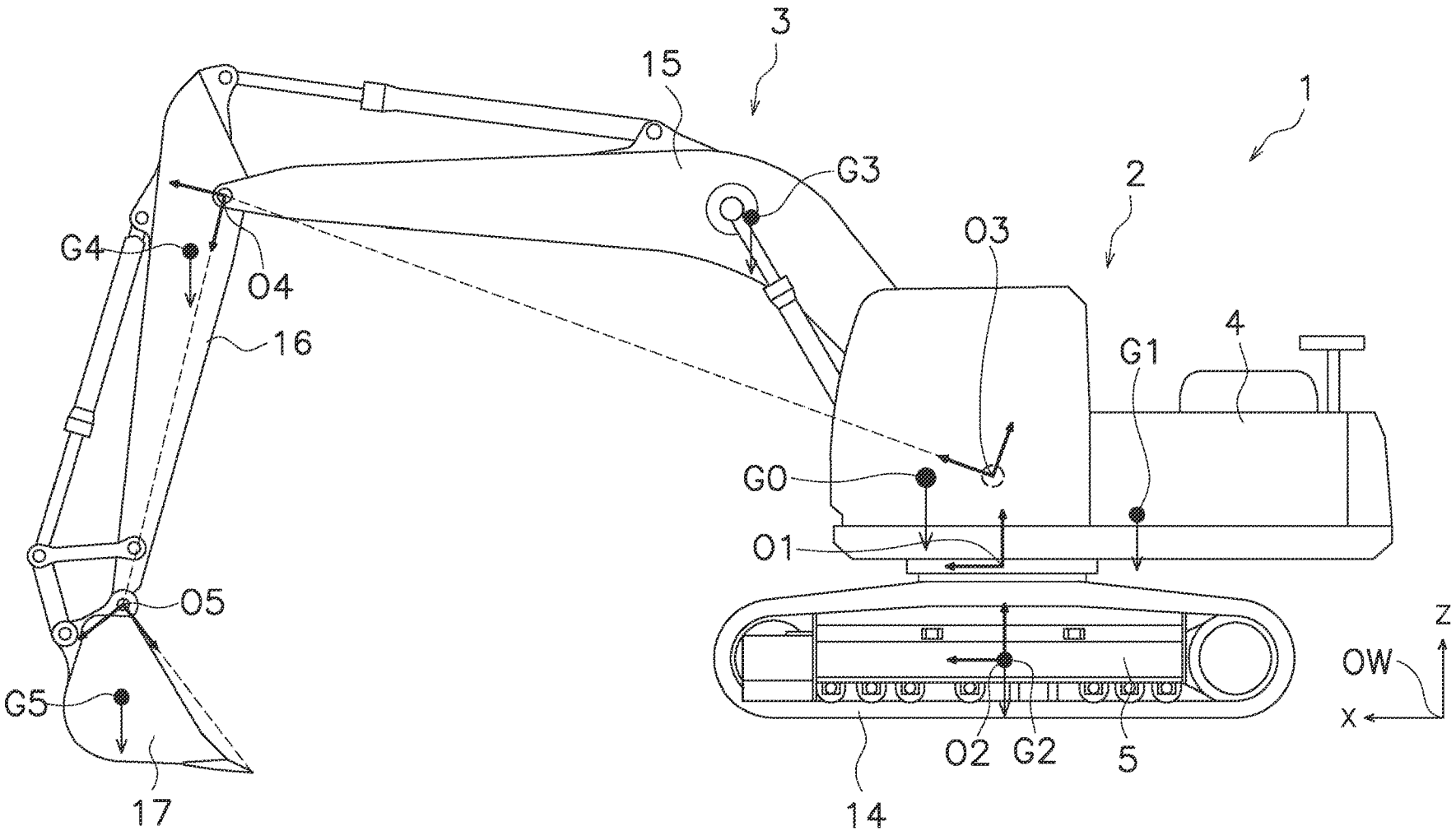
FIG. 5 illustrates the center of gravity positions of a plurality of constituent portions of the work machine.

In step S5, the controller 30 acquires the center of gravity positions of the constituent portions. FIG. 5 illustrates the center of gravity positions of the plurality of constituent portions of the work machine 1. The storage device 36 stores the center of gravity position G1 of the rotating body 4, the center of gravity position G2 of the traveling body 5, the center of gravity position G3 of the boom 15, the center of gravity position G4 of the arm 16, and the center of gravity position G5 of the attachment 17.

The center of gravity position G1 of the rotating body 4 is represented by the coordinate system of the rotating body 4. The coordinate system of the rotating body 4 is a coordinate system fixed to the rotating body 4 and has a point of origin O1 in the rotating body 4. The center of gravity position G2 of the traveling body 5 is represented by a coordinate system of the traveling body 5. The coordinate system of the traveling body 5 is a coordinate system fixed to the traveling body 5 and has a point of origin O2 in the traveling body 5.

The center of gravity position G3 of the boom 15 is represented by a coordinate system of the boom 15. The coordinate system of the boom 15 is a coordinate system fixed to the boom 15 and has a point of origin O3 in the boom 15. The center of gravity position G4 of the arm 16 is represented by a coordinate system of the arm 16. The coordinate system of the arm 16 is a coordinate system fixed to the arm 16 and has a point of origin O4 in the arm 16. The center of gravity position G5 of the attachment 17 is represented by a coordinate system of the attachment 17. The coordinate system of the attachment 17 is a coordinate system fixed to the attachment 17 and has a point of origin O5 in the attachment 17. The controller 30 acquires the center of gravity positions G1 to G5 of the constituent portions from the storage device 36.

In step S6, the controller 30 acquires the masses of the constituent portions. The storage device 36 stores the mass of the rotating body 4, the mass of the traveling body 5, the mass of the boom 15, the mass of the arm 16, and the mass of the attachment 17. The controller 30 acquires the masses of the constituent portions from the storage device 36.

In step S7, the controller 30 acquires conversion matrices of the coordinates. The controller 30 acquires the conversion matrix of the rotating body 4, the conversion matrix of the traveling body 5, the conversion matrix of the boom 15, the conversion matrix of the arm 16, and the conversion matrix of the attachment 17. The conversion matrix of the rotating body 4 is a conversion matrix for converting the coordinate system of the rotating body 4 to the standard coordinate system. The conversion matrix of the traveling body 5 is a conversion matrix for converting the coordinate system of the traveling body 5 to the coordinate system of the rotating body 4. The conversion matrix of the boom 15 is a conversion matrix for converting the coordinate system of the boom 15 to the coordinate system of the rotating body 4. The conversion matrix of the arm 16 is a conversion matrix for converting the coordinate system of the arm 16 to the coordinate system of the boom 15. The conversion matrix of the attachment 17 is a conversion matrix for converting the coordinate system of the attachment 17 to the coordinate system of the arm 16.

The conversion matrices of the constituent portions change in response to the attitude of each constituent portion. The storage device 36 stores the positional relationships of the respective points of origin O1 to O5 of the coordinate system of the rotating body 4, the coordinate system of the traveling body 5, the coordinate system of the boom 15, the coordinate system of the arm 16, and the coordinate system of the attachment 17. The controller 30 calculates the conversion matrices of the constituent portions based on the positional relationships of the points of origin O1 to O5 in each coordinate system and the above-mentioned dimensional data, positional data, directional data, and angle data.

In step S8, the controller 30 calculates the center of gravity position G0 of the entire work machine 1. The controller 30 calculates the center of gravity G0 of the entire work machine 1 based on the center of gravities G1 to G5, the masses, and the conversion matrices of the constituent portions. Specifically, the controller 30 first converts the center of gravity positions of the constituent portions to the standard coordinate system using the following equations (1) to (5).

$$^{world}P_{upper} = {}^{world}T_{upper}\,{}^{upper}P \quad (1)$$

$$^{world}P_{under} = {}^{world}T_{upper}\,{}^{upper}T_{under}\,{}^{under}P \quad (2)$$

$$^{world}P_{boom} = {}^{world}T_{upper}\,{}^{upper}T_{boom}\,{}^{boom}P \quad (3)$$

$$^{world}P_{arm} = {}^{world}T_{upper}\,{}^{upper}T_{boom}\,{}^{boom}T_{arm}\,{}^{arm}P \quad (4)$$

$$^{world}P_{attachment} = {}^{world}T_{upper}\,{}^{upper}T_{boom}\,{}^{boom}T_{arm}\,{}^{arm}T_{attachment}\,{}^{attachment}P \quad (5)$$

"$^{world}P_{upper}$" represents the center of gravity position G1 of the rotating body 4 in the standard coordinate system. "$^{upper}P$" represents the center of gravity position G1 of the rotating body 4 in the coordinate system of the rotating body 4. "$^{world}T_{upper}$" represents the conversion matrix for converting from the coordinate system of the rotating body 4 to the standard coordinate system.

"$^{world}P_{under}$" represents the center of gravity position G2 of the traveling body 5 in the standard coordinate system. "$^{upper}T_{under}$" represents the conversion matrix for converting from the coordinate system of the traveling body 5 to the coordinate system of the rotating body 4. "under P" represents the center of gravity position G2 of the traveling body 5 in the coordinate system of the traveling body 5.

"$^{world}P_{boom}$" indicates the center of gravity position G3 of the boom 15 in the standard coordinate system. "$^{upper}T_{boom}$" represents the conversion matrix for converting from the coordinate system of the boom 15 to the coordinate system of the rotating body 4. "$^{boom}P$" represents the center of gravity position G3 of the boom 15 in the coordinate system of the boom 15.

"$^{world}P_{arm}$" indicates the center of gravity position G4 of the arm 16 in the standard coordinate system. "$^{boom}T_{arm}$" represents the conversion matrix for converting from the coordinate system of the arm 16 to the coordinate system of the boom 15. "$^{arm}P$" represents the center of gravity position G4 of the arm 16 in the coordinate system of the arm 16.

"$^{world}P_{attachment}$" indicates the center of gravity position G5 of the attachment 17 in the standard coordinate system. "$^{arm}T_{attachment}$" represents the conversion matrix for converting from the coordinate system of the attachment 17 to the coordinate system of the arm 16. "$^{attachment}P$" indicates the center of gravity position G5 of the attachment 17 in the coordinate system of the attachment 17.

Next, the controller 30 calculates the center of gravity position G0 of the entire work machine 1 using the following equation (6).

$$^{world}P_{all} = \left(^{world}P_{upper}\cdot \mathrm{mass}_{upper} + {}^{world}P_{under}\cdot \mathrm{mass}_{under} + {}^{world}P_{boom}\cdot \mathrm{mass}_{boom} + {}^{world}P_{arm}\cdot \mathrm{mass}_{arm} + {}^{world}P_{attachment}\cdot \mathrm{mass}_{attachment}\right)/\mathrm{mass}_{all} \quad (6)$$

"$^{world}P_{all}$" represents the center of gravity position G0 of the entire work machine 1 in the standard coordinate system. "$\mathrm{mass}_{upper}$" represents the mass of the rotating body 4. "$\mathrm{mass}_{under}$" represents the mass of the traveling body 5. "$\mathrm{mass}_{boom}$" represents the mass of the boom 15. "$\mathrm{mass}_{arm}$" represents the mass of the arm 16. "$\mathrm{mass}_{attachment}$" represents the mass of the attachment 17. "$\mathrm{mass}_{all}$" represents the mass of the entire work machine 1.

In step S9, the controller 30 determines whether there has been an input of a parameter via the input device 32. The input device 32 receives the input of a parameter for determining the center of gravity positions of the constituent portions. Specifically, the controller 30 causes the display 33 to display the setting screens illustrated in FIG. 6 to FIG. 10.

Figure 6:
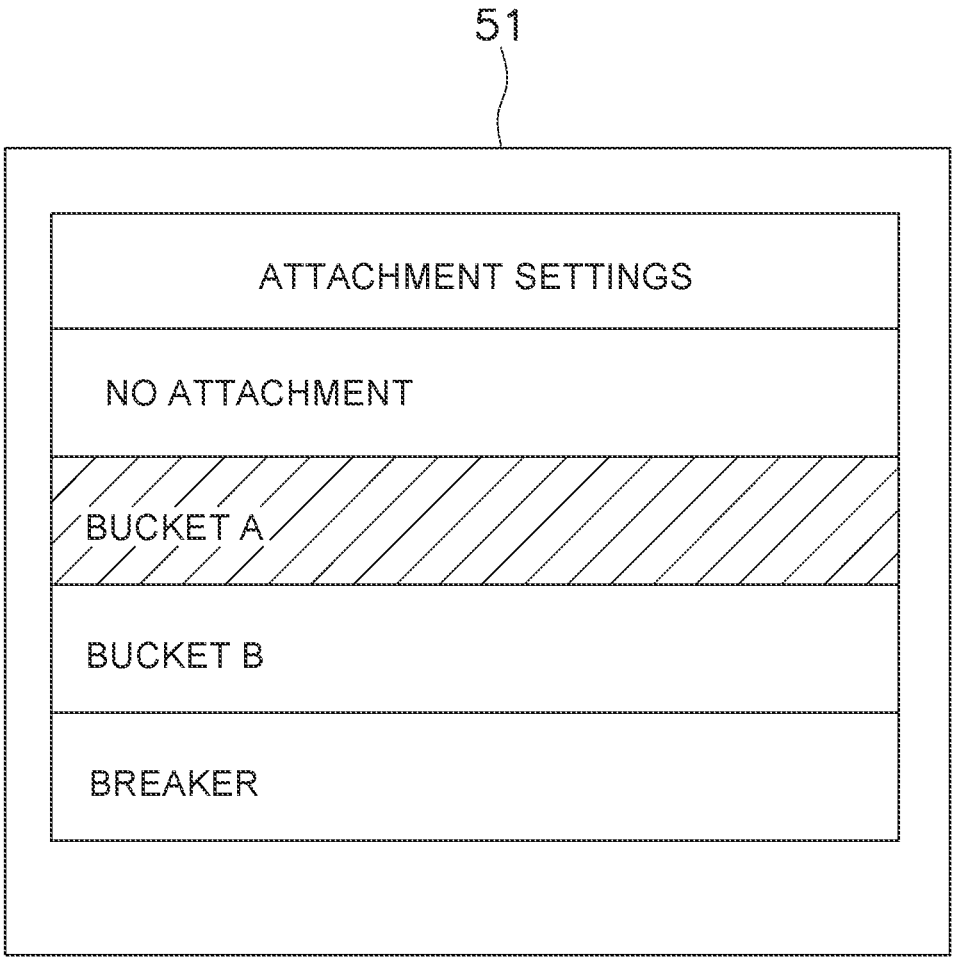
FIG. 6 illustrates an example of an attachment setting screen.

FIG. 6 illustrates an example of a setting screen 51 for the attachment 17. A plurality of types of attachments 17 are displayed on the setting screen 51 for the attachment 17. The plurality of types of attachments 17 represent types of attachments 17 having different dimensions and/or masses or different functions. When the attachment 17 is replaced, the worker uses the input device 32 to select the type of the attachment 17 after the replacement. The controller 30 acquires the selected type of the attachment 17 as the parameter of the center of gravity position G5 of the attachment 17.

Figure 7:
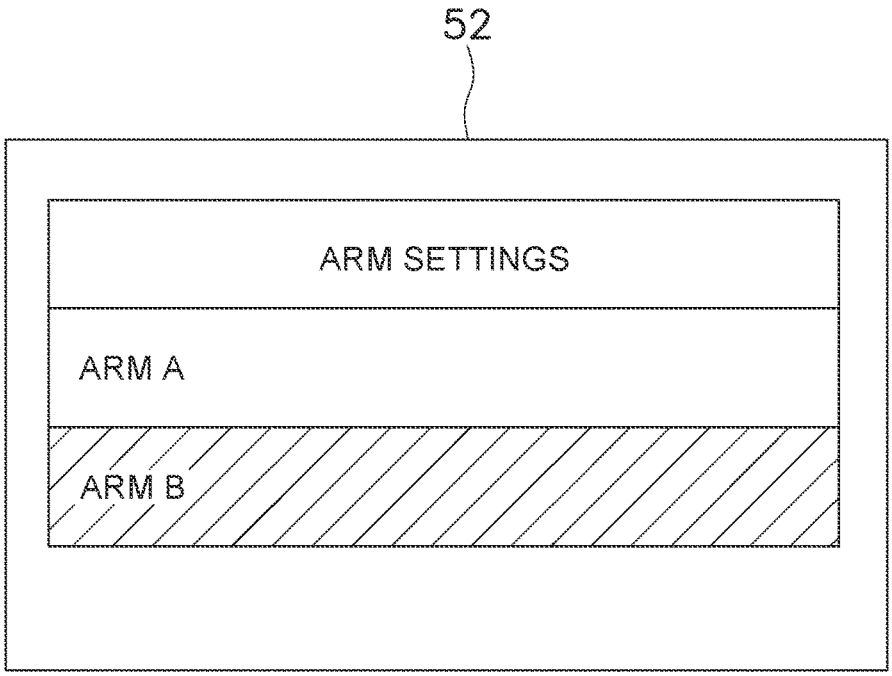
FIG. 7 illustrates an example of an arm setting screen.

FIG. 7 illustrates an example of a setting screen 52 of the arm 16. A plurality of types of arms 16 are displayed on the setting screen 52 of the arm 16. The plurality of types of arms 16 represent a plurality of types of arms 16 having different dimensions and/or masses. When the arm 16 is replaced, the worker uses the input device 32 to select the type of the arm 16 after the replacement. The controller 30 acquires the selected type of the arm 16 as the parameter of the center of gravity position G4 of the arm 16.

Figure 8:
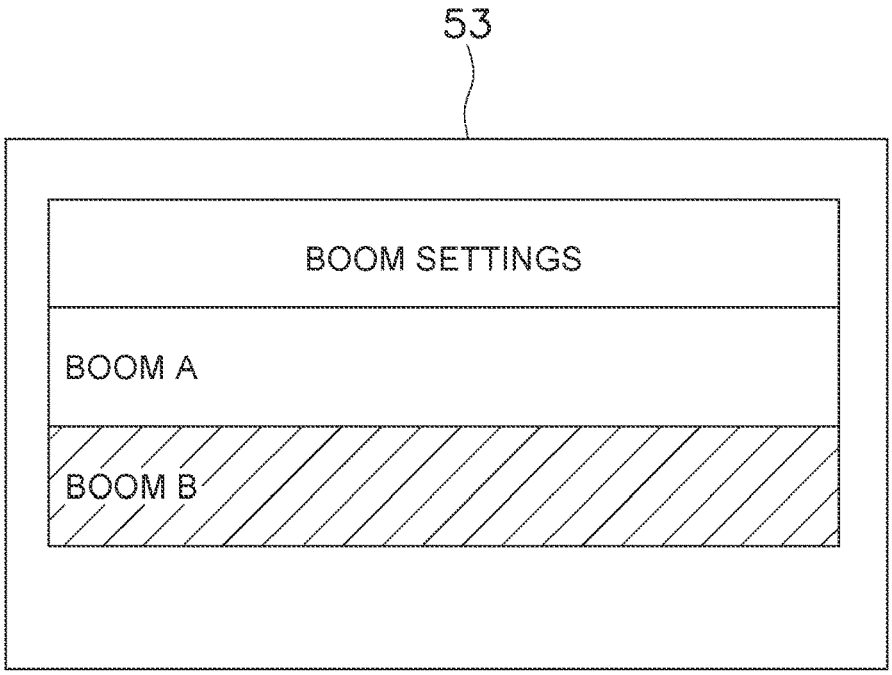
FIG. 8 illustrates an example of a boom setting screen.

FIG. 8 illustrates an example of a setting screen 53 for the boom 15 A plurality of types of booms 15 are displayed on the setting screen 53 of the boom 15. The plurality of types of booms 15 represent a plurality of types of booms 15 having different dimensions and/or masses. When the boom 15 is replaced, the worker uses the input device 32 to select the type of the boom 15 after the replacement. The controller 30 acquires the selected type of the boom 15 as the parameter of the center of gravity position G3 of the boom 15.

Figure 9:
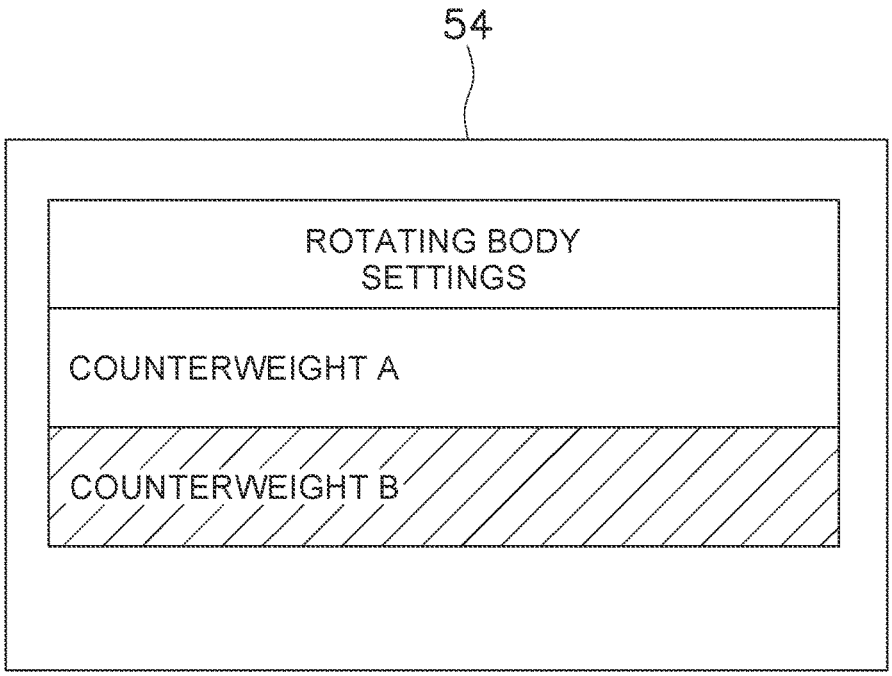
FIG. 9 illustrates an example of a rotating body setting screen.

FIG. 9 illustrates an example of a setting screen 54 for the rotating body 4. A plurality of types of counterweights 7 are displayed on the setting screen 54 for the rotating body 4. The plurality of types of counterweights 7 represent a plurality of types of counterweights having different dimensions and/or masses. When the counterweight 7 is replaced, the worker uses the input device 32 to select the type of the counterweight 7 after the replacement. The controller 30 acquires the selected type of the counterweight 7 as the parameter of the center of gravity position G1 of the rotating body 4.

Figure 10:
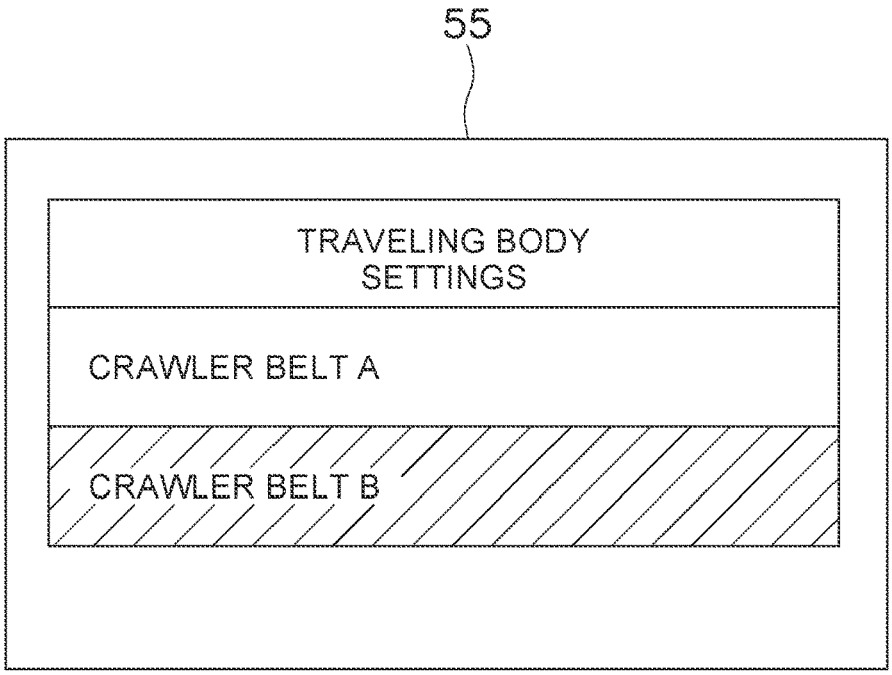
FIG. 10 illustrates an example of a traveling body setting screen.

FIG. 10 illustrates an example of a setting screen 55 for the traveling body 5. A plurality of types of crawler belts 14 are displayed on the setting screen 55 for the traveling body 5. The plurality of types of crawler belts 14 represent a plurality of types of crawler belts 14 having different dimensions and/or masses. When the crawler belts are replaced, the worker uses the input device 32 to select the type of the crawler belt 14 after the replacement. The controller 30 acquires the selected type of the crawler belt 14 as the parameter of the center of gravity position G2 of the traveling body 5.

When the parameter of the center of gravity position of one of the constituent portions has been inputted by means of the input device 32, the process advances to step S10. In step S10, the controller 30 updates the center of gravity position of the constituent portion for which parameter has been inputted.

For example, when the attachment 17 is replaced from bucket A to bucket B, a worker uses the input device 32 to select the bucket B on the setting screen 51 of the attachment 17.

The storage device 36 stores specification data of each type of the attachment 17. As illustrated in FIG. 11, the specification data 56 includes the plurality of types of attachments 17 and the dimensions and masses of the attachments 17 corresponding to each of the plurality of types. The dimensions of the attachment 17 include, for example, the abovementioned attachment length L3. The controller 30 updates the dimensional data and the mass of the attachment 17 with the dimensions and mass corresponding to the selected type. Additionally, the controller 30 updates the center of gravity position G5 of the attachment 17 with the updated dimensional data and mass of the attachment 17.

Similarly for the rotating body 4, the traveling body 5, the boom 15, and the arm 16, the storage device 36 stores the respective specification data of the rotating body 4, the traveling body 5, the boom 15, and the arm 16. The specification data of the rotating body 4 includes the plurality of types of counterweights 7 and the dimensions and mass of the counterweights 7 corresponding to each of the plurality of types. When the type of the counterweight 7 is selected with the input device 32, the controller 30 updates the center of gravity position G1 of the rotating body 4 with the dimensional data and mass of the selected counterweight 7.

The specification data of the traveling body 5 includes the plurality of types of traveling bodies 5 and the dimensions and mass of the traveling bodies 5 corresponding to each of the plurality of types. When the type of the crawler belt 14 is selected with the input device 32, the controller 30 updates the center of gravity position G2 of the traveling body 5 with the dimensional data and mass of the selected crawler belt 14.

The specification data of the boom 15 includes the plurality of types of booms 15 and the dimensions and mass of the booms 15 corresponding to each of the plurality of types. When the type of the boom 15 is selected with the input device 32, the controller 30 updates the center of gravity position G3 of the boom 15 with the dimensional data and mass of the selected boom 15.

The specification data of the arm 16 includes the plurality of types of arms 16 and the dimensions and mass of the arms 16 corresponding to each of the plurality of types. When the type of the arm 16 is selected with the input device 32, the controller 30 updates the center of gravity position G4 of the arm 16 with the dimensional data and mass of the selected arm 16.

In step S11, the controller 30 updates the masses of the constituent portions. The controller updates the masse of the constituent portion for which a parameter has been inputted with the input device 32, with the abovementioned specification data. In step S12, the controller 30 updates the conversion matrix of the coordinates. The controller 30 updates the conversion matrix of the constituent portion for which a parameter has been inputted with the input device 32, with the abovementioned specification data. The process then returns to steps S1 to S8 and the controller 30 updates the center of gravity position G0 of the entire work machine 1 based on the center of gravity positions of the plurality of constituent portions that include the updated center of gravity position of the constituent portion.

For example, when the attachment 17 is replaced, the type of the attachment 17 after the replacement is selected with the input device 32 whereby the center of gravity position G5, the mass, and the conversion matrix of the attachment 17 are updated. The center of gravity position G0 of the entire work machine 1 is calculated using the updated center of gravity position G5, mass, and conversion matrix of the attachment 17 and the center of gravity positions G1 to G4, the masses, and the conversion matrices of the other constituent portions by using the abovementioned equations (1) to (6), whereby the center of gravity position G0 of the entire work machine 1 is updated.

An explanation of the dimensions in the width direction of the work machine 1 and the constituent portions has been omitted for ease of explanation in the above explanation. However, the dimensions in the width direction of the work machine 1 and the constituent portions may be taken into account in the calculation of the center of gravity positions.

Figure 12:
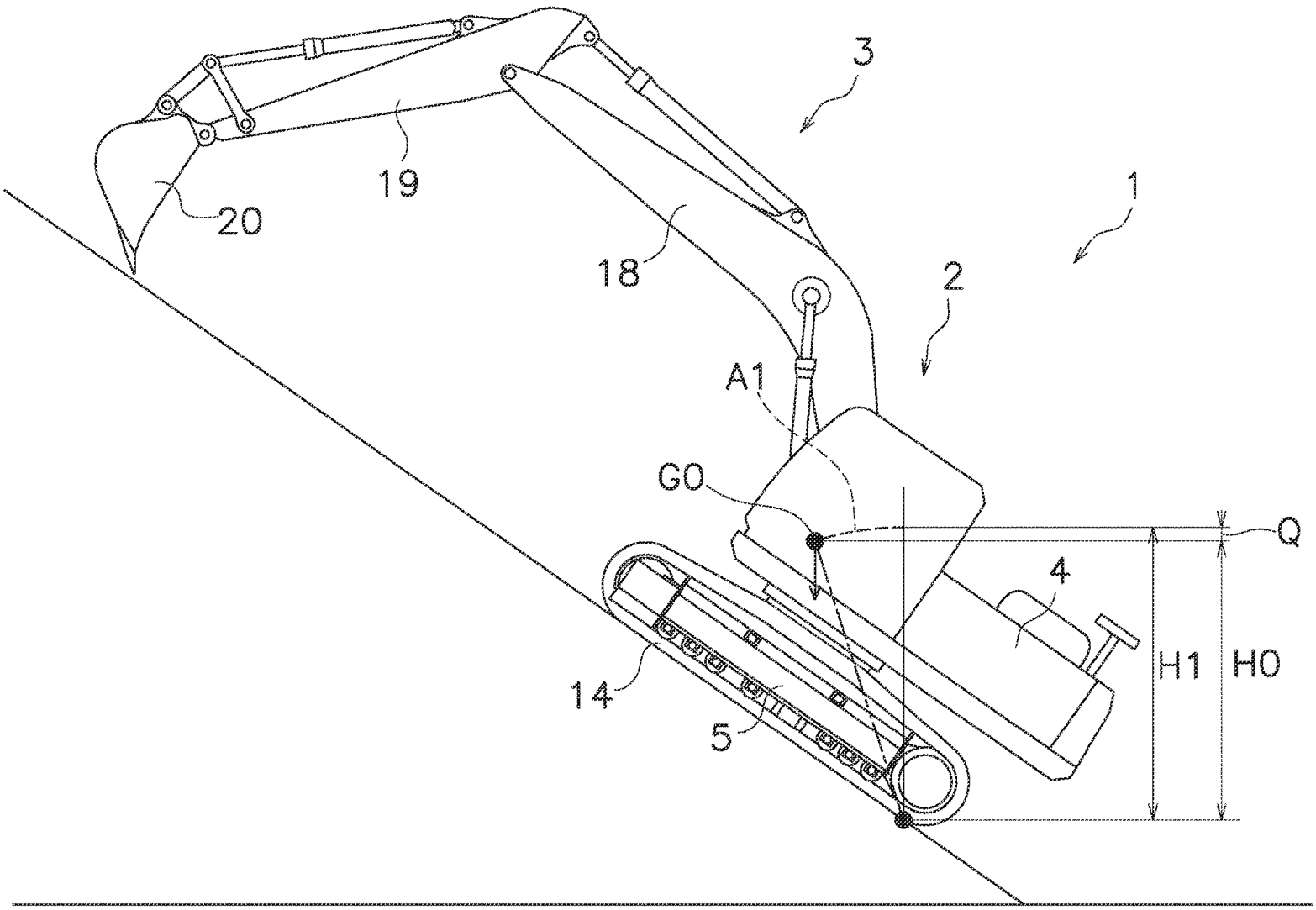
FIG. 12 illustrates a method for calculating an overturning margin.

As described above, the controller 30 calculates the center of gravity position G0 of the entire work machine 1. The controller 30 assesses the possibility of overturning of the work machine 1 based on the center of gravity position G0 of the entire work machine 1. For example, as illustrated in FIG. 12, the controller 30 may assess the possibility of overturning of the work machine 1 based on an overturning margin Q. The overturning margin Q is represented by the difference between a maximum height H1 of a trajectory A1 drawn by the center of gravity position G0 of the entire work machine 1 when the work machine 1 overturns, and an initial height H0 of the center of gravity position. The possibility of overturning correspondingly decreases as the overturning margin Q increases.

Figure 13:
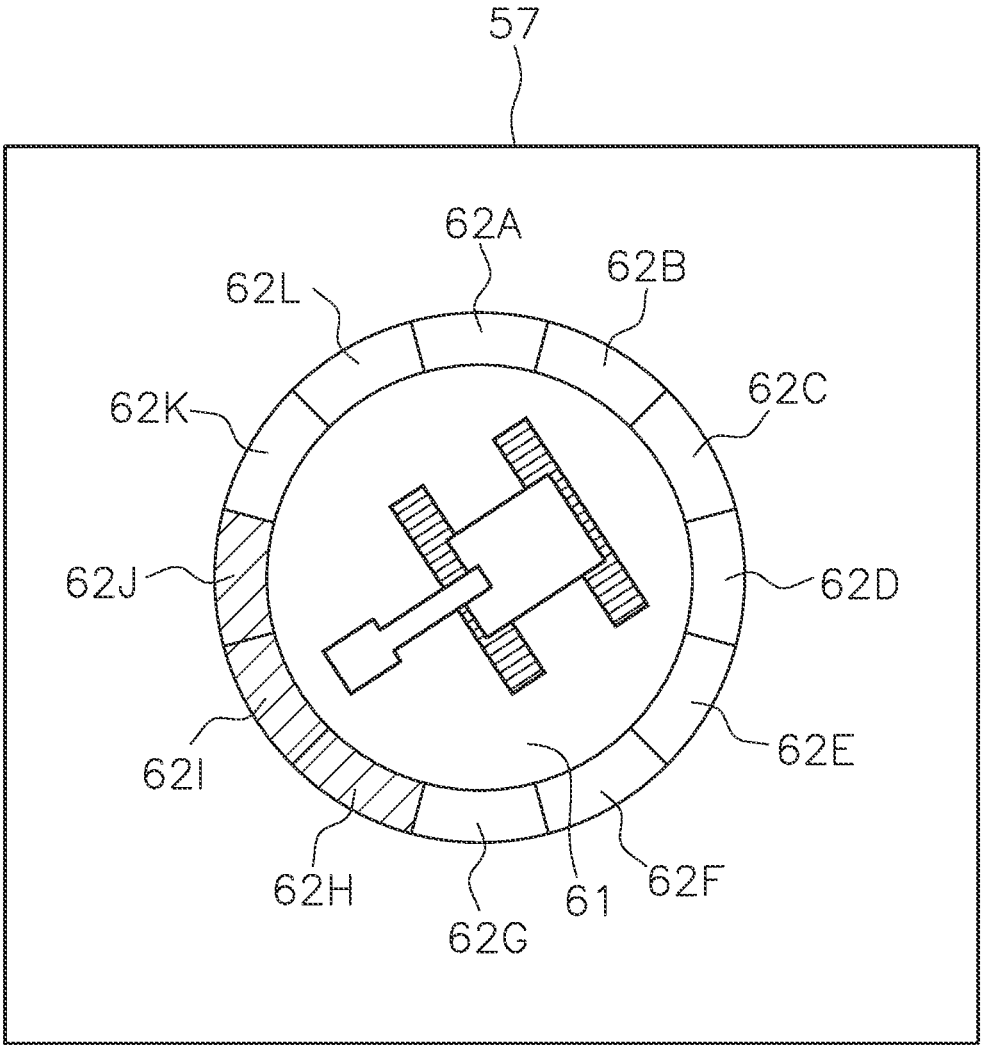
FIG. 13 illustrates an example of a screen indicating the possibility of overturning.

The controller 30 may cause a warning display to be displayed on the display 33 in response to the overturning margin Q. For example, as illustrated in FIG. 13, the controller 30 may cause the display 33 to display a screen 57 that indicates the possibility of overturning. Areas 62A to 62L obtained by dividing the periphery of the work machine 1 into multiple areas are displayed along with an image 61 of the work machine 1 on the screen 57 that indicates the possibility of overturning.

The controller 30 calculates the overturning margin Q of the work machine 1 in the directions of the areas 62A to 62L. The controller 30 displays the areas 62A to 62L in different colors in accordance with the overturning margin Q. For example, the areas 62H to 62J in which the overturning margin Q is equal to or less than a threshold are displayed in a different color than the other areas.

In the control system 10 of the work machine 1 according to the present embodiment discussed above, when one portion of the constituent portions of the work machine 1 is replaced, the parameter of the constituent portion after the replacement is inputted via the input device 32 whereby the center of gravity position of said constituent portion is updated. The center of gravity position G0 of the entire work machine 1 is calculated based on the updated center of gravity position of the constituent portion. Consequently, the center of gravity position G0 of the entire work machine 1 is calculated accurately even after a portion of the constituent portions has been replaced.

Although an embodiment of the present invention has been described so far, the present invention is not limited to the above embodiment and various modifications may be made within the scope of the invention.

The work machine 1 is not limited to a hydraulic excavator and may be another work machine such as a bulldozer, a wheel loader, or a motor grader or the like. The configuration of the work implement 3 is not limited to the above embodiment and may be modified. For example, the work implement 3 is not limited to the three-axis structure of the boom 15, the arm 16, and the attachment 17 and may have four or more axes.

The work machine 1 may be a vehicle that can be remotely operated. In this case, a portion of the control system 10 may be disposed outside of the work machine 1. For example, the controller 30 may be disposed outside the work machine 1. The operating device 31, the input device 32, and the display 33 may also be disposed outside of the work machine 1. The input device 32 and the display 33 may also be a computer separate from the work machine 1. For example, the input device 32 and the display 33 may be included in a computer that is operated by a service man of the work machine 1.

The controller 30 may include a plurality of controllers separate from each other. The abovementioned processes of the controller 30 may distributed and executed among the plurality of controllers. The controller 30 may include a plurality of processors. The abovementioned processes by the controller 30 may distributed and executed among the plurality of processors.

The processing by the controller 30 is not limited to the above embodiment and may be changed. A portion of the abovementioned processing may be omitted. Alternatively, a portion of the abovementioned processing may be changed. For example, in the above embodiment, the work machine 1 is divided into the five constituent portions of the rotating body 4, the traveling body 5, the boom 15, the arm 16, and the attachment 17 in order to calculate the center of gravity position G0 of the entire work machine 1. However, the number of the constituent portions is not limited five and may be less than five or greater than five.

In the above embodiment, the controller 30 displays a warning display on the display 33 in accordance with the overturning margin Q. However, the controller 30 may also emit a warning sound in accordance with the overturning margin Q. In the above embodiment, the controller 30 calculates the overturning margin Q based on the center of gravity position G0 of the entire work machine 1. However, the controller 30 may simply display the center of gravity position G0 of the entire work machine 1 on the display 33.

In the above embodiment, the type of the constituent portion is selected as a parameter for calculating the center of gravity position of the constituent portion, using the input device 32. However, the parameter is not limited to the type of the constituent portion and may be the center of gravity position of each constituent portion. Alternatively, the parameter may be the dimensions and the mass of each constituent portion.

Figure 14:
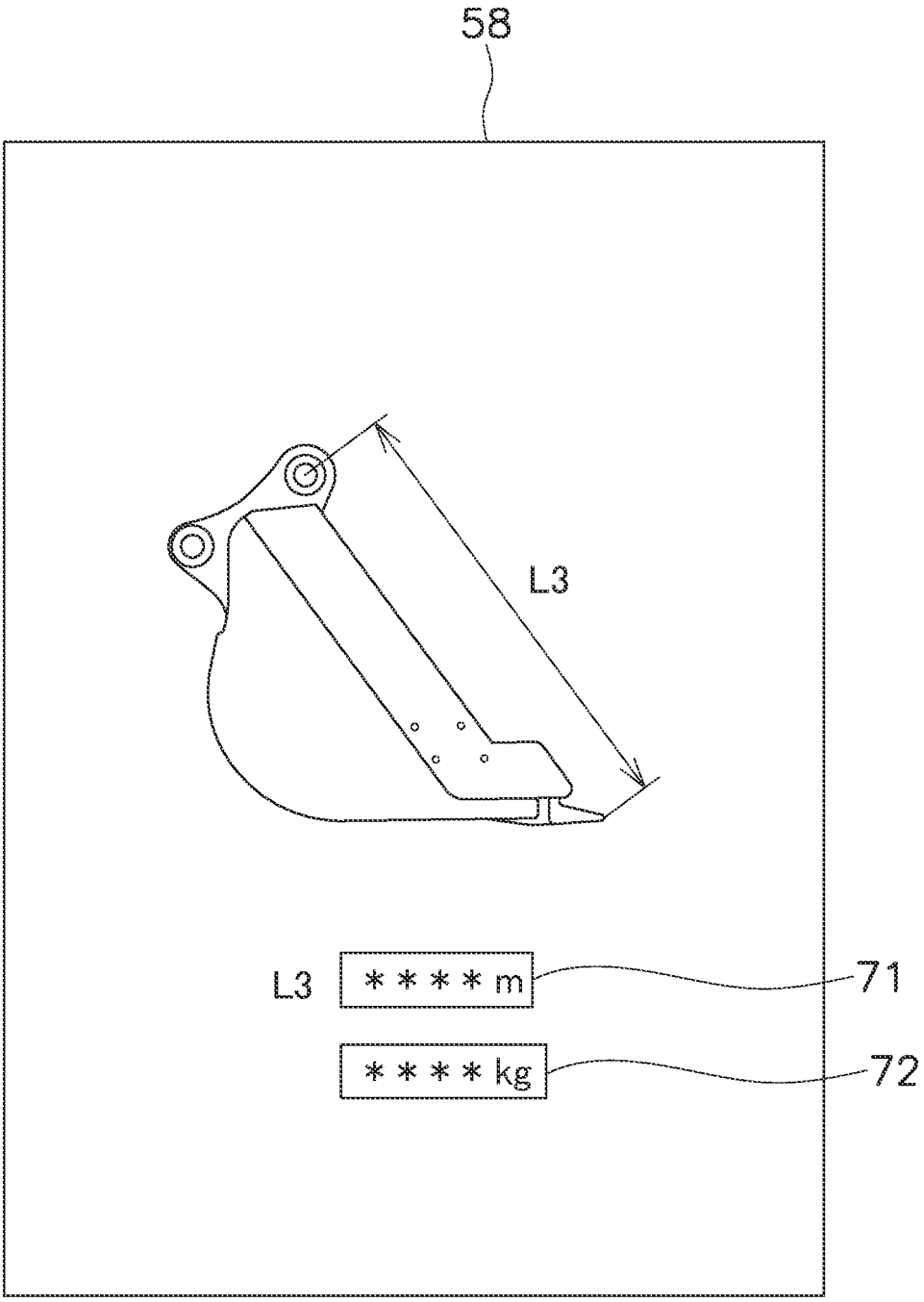
FIG. 14 illustrates an example of an attachment setting screen according to a modified example.

For example, FIG. 14 illustrates an example of a setting screen 58 for the attachment 17 according to a modified example. As illustrated in FIG. 14, the setting screen 58 of the attachment 17 may include an input field 71 for the dimensions and an input field 72 for the mass of the attachment 17.

Figure 15:
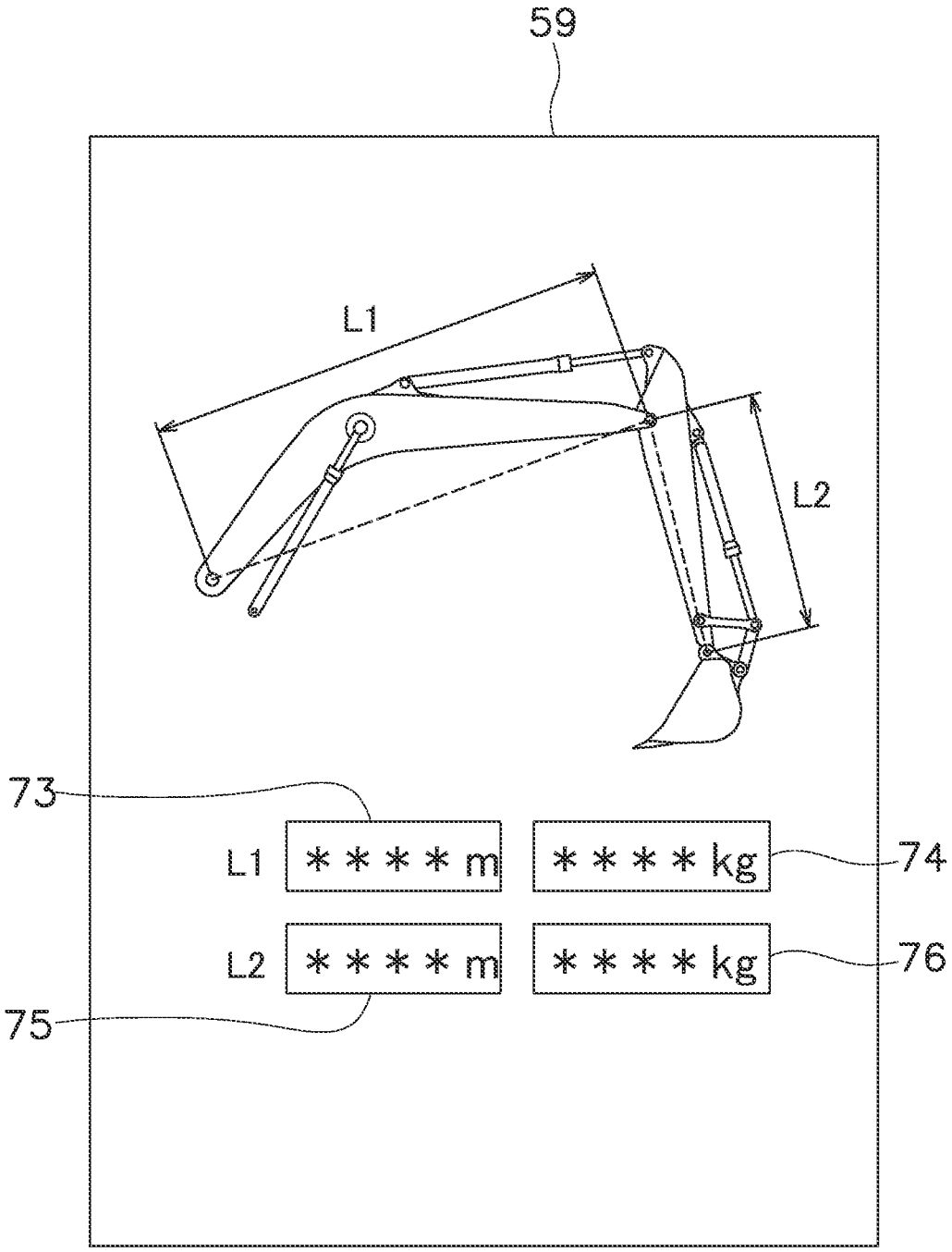
FIG. 15 illustrates an example of a boom and arm setting screen according to a modified example.

FIG. 15 illustrates an example of a setting screen 59 for the boom 15 and the arm 16 according to a modified example. As illustrated in FIG. 15, the setting screen 59 of the boom 15 and the arm 16 may include an input field 73 for the dimensions and an input field 74 for the mass of the boom 15. The setting screen 59 of the boom 15 and the arm 16 may also include an input field 75 for the dimensions and an input field 76 for the mass of the arm 16.

Figure 16:
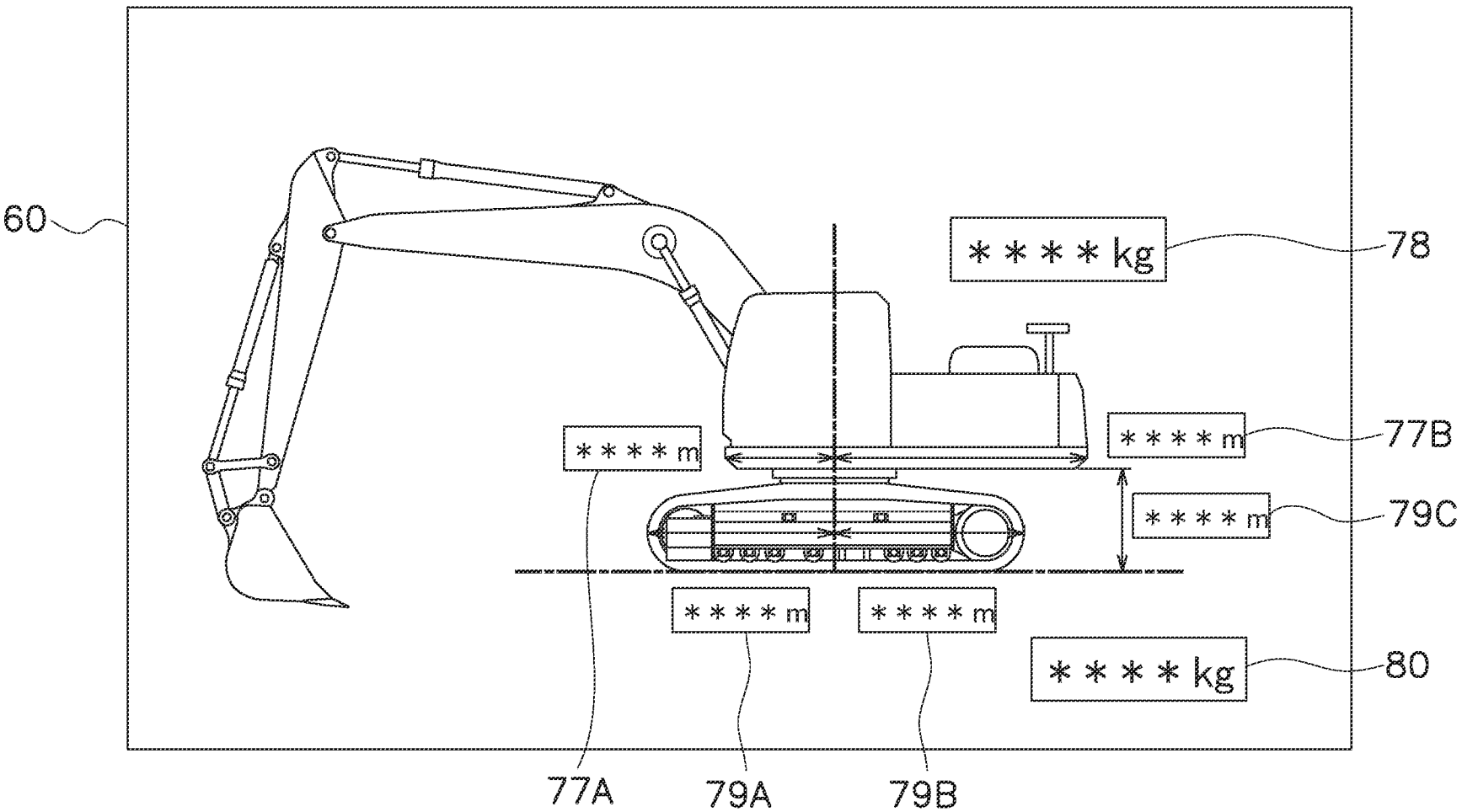
FIG. 16 illustrates an example of a rotating body and traveling body setting screen according to a modified example.

FIG. 16 illustrates an example of a setting screen 60 for the rotating body 4 and the traveling body 5 according to a modified example. As illustrated in FIG. 16, the setting screen 60 of the rotating body 4 and the traveling body 5 may include input fields 77A and 77B for the dimensions and an input field 78 for the mass of the rotating body 4. Alternatively, the setting screen 60 of the rotating body 4 and the traveling body 5 may include an input field for the dimensions and an input field for the mass of the counterweight 7.

As illustrated in FIG. 16, the setting screen 60 of the rotating body 4 and the traveling body 5 may include input fields 79A and 79C for the dimensions and an input field 80 for the mass of the traveling body 5. Alternatively, the setting screen 60 of the rotating body 4 and the traveling body 5 may include an input field for the dimensions and an input field for the mass of the crawler belts 14.

According to the present invention, it is possible to accurately calculate the center of gravity position of the entire work machine even after a portion of the constituent portions have been replaced in the work machine.

The invention claimed is:

1. A system for a work machine including a plurality of constituent portions including a first portion, the system comprising:

a storage device that stores center of gravity positions of the plurality of constituent portions;

an input device that receives input of a first parameter for determining the center of gravity position of the first portion;

a display; and a controller configured to calculate a center of gravity position of the entire work machine based on the center of gravity positions of the plurality of constituent portions, set the center of gravity position of the first portion by using the first parameter when the first parameter is inputted with the input device, set the center of gravity position of the entire work machine based on the center of gravity positions of the plurality of constituent portions that include the set center of gravity position of the first portion, assess whether there exists a possibility of the work machine overturning based on the center of gravity position of the entire work machine, and control the display to display a warning indicating the possibility of the work machine overturning in response to a result of the assessment, the warning including an image of the work machine surrounded by a plurality of marks, at least one of the plurality of marks being displayed in a different color than others of the plurality of marks to indicate a direction in which the possibility of the work machine overturning exists.

2. The system according to claim 1, wherein the storage device stores a plurality of types of the first portion and specification data that includes a dimension and a mass of the first portion corresponding to each of the plurality of types, and the first parameter is selected from the plurality of types of the first portion.

3. The system according to claim 1, wherein the first parameter includes a dimension and a mass of the first portion.

4. The system according to claim 1, wherein the first parameter includes the center of gravity position of the first portion.

5. The system according to claim 1, wherein the plurality of constituent portions further include a second portion, the input device receives input of a second parameter for determining a center of gravity position of the second portion, and the controller is configured to set the center of gravity position of the second portion by using the second parameter when the second parameter is inputted with the input device, and set the center of gravity position of the entire work machine based on the center of gravity positions of the plurality of constituent portions that include the set center of gravity position of the second portion.

6. The display system according to claim 5, wherein the storage device stores a plurality of types of the second portion and specification data that includes a dimension and a mass of the second portion corresponding to each of the plurality of types, and the second parameter is selected from the plurality of types of the second portion.

7. The system according to claim 5, wherein the second parameter includes a dimension and a mass of the second portion.

8. The system according to claim 5, wherein the second parameter includes the center of gravity position of the second portion.

9. The system according to claim 1, further comprising:

a display, the controller being configured to cause the display to display an input field for the first parameter.

10. The system according to claim 5, further comprising:

a display, the controller being configured to cause the display to display an input field for the second parameter.

11. The system according to claim 1, wherein the work machine includes a vehicle body, and a work implement that includes a replaceable attachment, the work implement being movable with respect to the vehicle body, and the first portion is the attachment.

12. The system according to claim 1, wherein the work machine includes a rotating body that includes a counterweight, the first portion is the rotating body, and the first parameter indicates a type of the counterweight and a dimension and a mass of the counterweight.

13. The system according to claim 1, wherein the work machine includes a traveling body that includes a crawler belt, the first portion is the traveling body, and the first parameter indicates a type of the crawler belt and a dimension and a mass of the crawler belt.

14. The work machine according to claim 1, wherein the first portion is the attachment, the attachment being replaceable with respect to the work implement.

15. The work machine according to claim 1, wherein the first portion is the rotating body, and the first parameter indicates a type of the counterweight and a dimension and a mass of the counterweight.

16. The work machine according to claim 1, wherein the first portion is the traveling body, and the first parameter indicates a type of the crawler belt and a dimension and a mass of the crawler belt.

17. A method for controlling a work machine including a plurality of constituent portions including a first portion, the method comprising:

acquiring center of gravity positions of the plurality of constituent portions;

calculating a center of gravity position of the entire work machine based on the center of gravity positions of the plurality of constituent portions;

receiving input of a first parameter for determining a center of gravity position of the first portion via an input device;

setting the center of gravity position of the first portion by using a first parameter when the first parameter is inputted with the input device;

setting the center of gravity position of the entire work machine based on the center of gravity positions of the plurality of constituent portions that include the set center of gravity position of the first portion;

assessing whether there exists a possibility of the work machine overturning based on the center of gravity position of the entire work machine; and controlling the display to display a warning indicating the possibility of the work machine overturning in response to a result of the assessment, the warning including an image of the work machine surrounded by a plurality of marks, at least one of the plurality of marks being displayed in a different color than others of the plurality of marks to indicate a direction in which the possibility of the work machine overturning exists.

18. The method according to claim 17, wherein the plurality of constituent portions further include a second portion, the input device receives input of a second parameter for determining a center of gravity position of the second portion, and the method further comprises:

setting the center of gravity position of the second portion by using the second parameter when the second parameter is inputted with the input device; and setting the center of gravity position of the entire work machine based on the center of gravity positions of the plurality of constituent portions that include the set center of gravity position of the second portion.

19. A work machine comprising:

a vehicle body;

a plurality of constituent portions of the work machine that include a first portion, the first portion being an attachment of a work implement that is movable with respect to the vehicle body, a rotating body of the vehicle body that includes a counterweight of the work machine, or a traveling body that includes a crawler belt;

a storage device that stores center of gravity positions of the plurality of constituent portions;

an input device that receives input of a first parameter for determining a center of gravity position of the first portion; and a controller configured to calculate a center of gravity position of the entire work machine based on the center of gravity positions of the plurality of constituent portions, set the center of gravity position of the first portion by using the first parameter when the first parameter is inputted with the input device, and set the center of gravity position of the entire work machine based on the center of gravity positions of the plurality of constituent portions that include the set center of gravity position of the first portion.

* * * * *